United States Patent [19]

Harding

[11] Patent Number: 4,975,015

[45] Date of Patent: Dec. 4, 1990

[54] BLISTER PACKAGE OPENING METHOD AND APPARATUS

[76] Inventor: Robert M. Harding, 2100 Swan Lane, Rolling Meadows, Ill. 60008

[21] Appl. No.: 334,442

[22] Filed: Apr. 7, 1989

[51] Int. Cl.[5] ..... B65D 83/04

[52] U.S. Cl. ..... 414/412; 414/786; 414/411; 221/25; 221/31; 206/532

[58] Field of Search ..... 414/403, 404, 411, 412, 414/786; 221/31, 25; 225/6, 23, 24; 206/534.1, 534.2, 532, 530, 531

[56] References Cited

U.S. PATENT DOCUMENTS

| | | | |
|---|---|---|---|
| 3,260,404 | 7/1966 | Critchell | 221/25 X |
| 3,482,733 | 12/1969 | Groves | 221/25 |
| 4,008,657 | 2/1977 | Yamamora et al. | 414/412 X |
| 4,096,945 | 6/1978 | Melton, Jr. et al. | 414/412 X |
| 4,428,709 | 1/1984 | Peters | 414/412 |
| 4,546,901 | 10/1985 | Buttarazzi | 221/25 X |
| 4,733,797 | 3/1988 | Haber | 221/31 X |
| 4,817,819 | 4/1989 | Kelly | 221/25 X |

FOREIGN PATENT DOCUMENTS

| | | | |
|---|---|---|---|
| 3317549 | 11/1984 | Fed. Rep. of Germany | 414/411 |

*Primary Examiner*—Frank E. Werner

[57] ABSTRACT

A method and apparatus for opening defective blister packages to recover their contained product that include shifting an inverted blister package against a stationary knife to partly sever its blisters and then camming the partly severed blisters open to discharge the product.

21 Claims, 7 Drawing Sheets

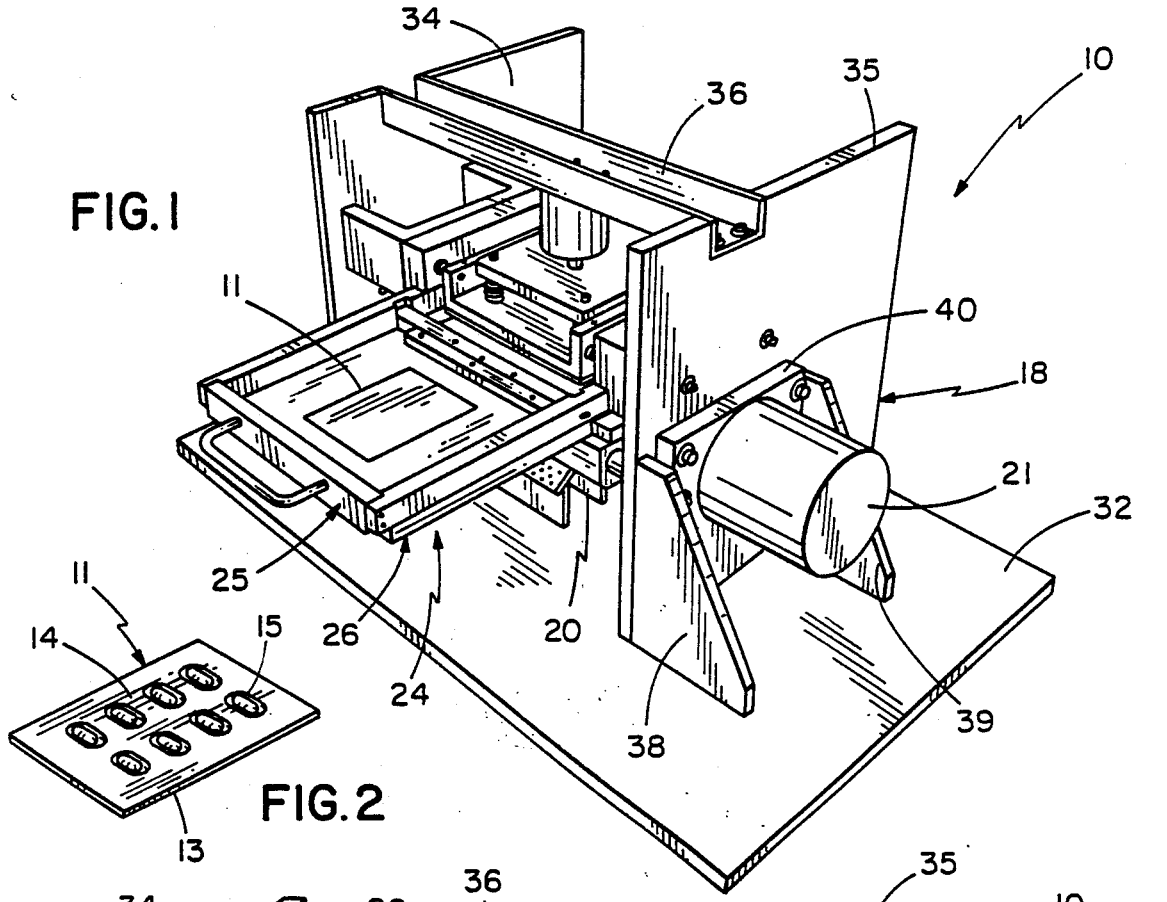
FIG. 1
FIG. 2
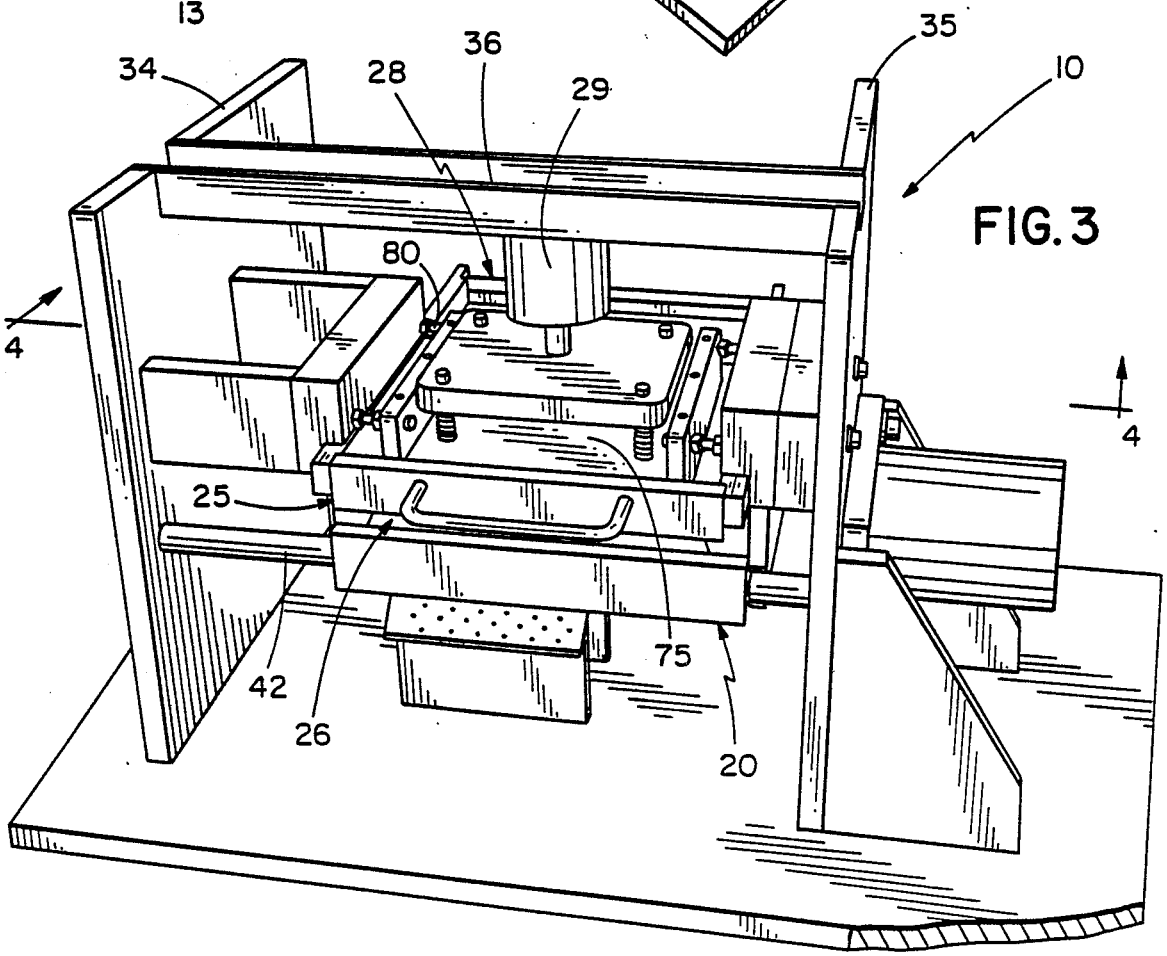
FIG. 3

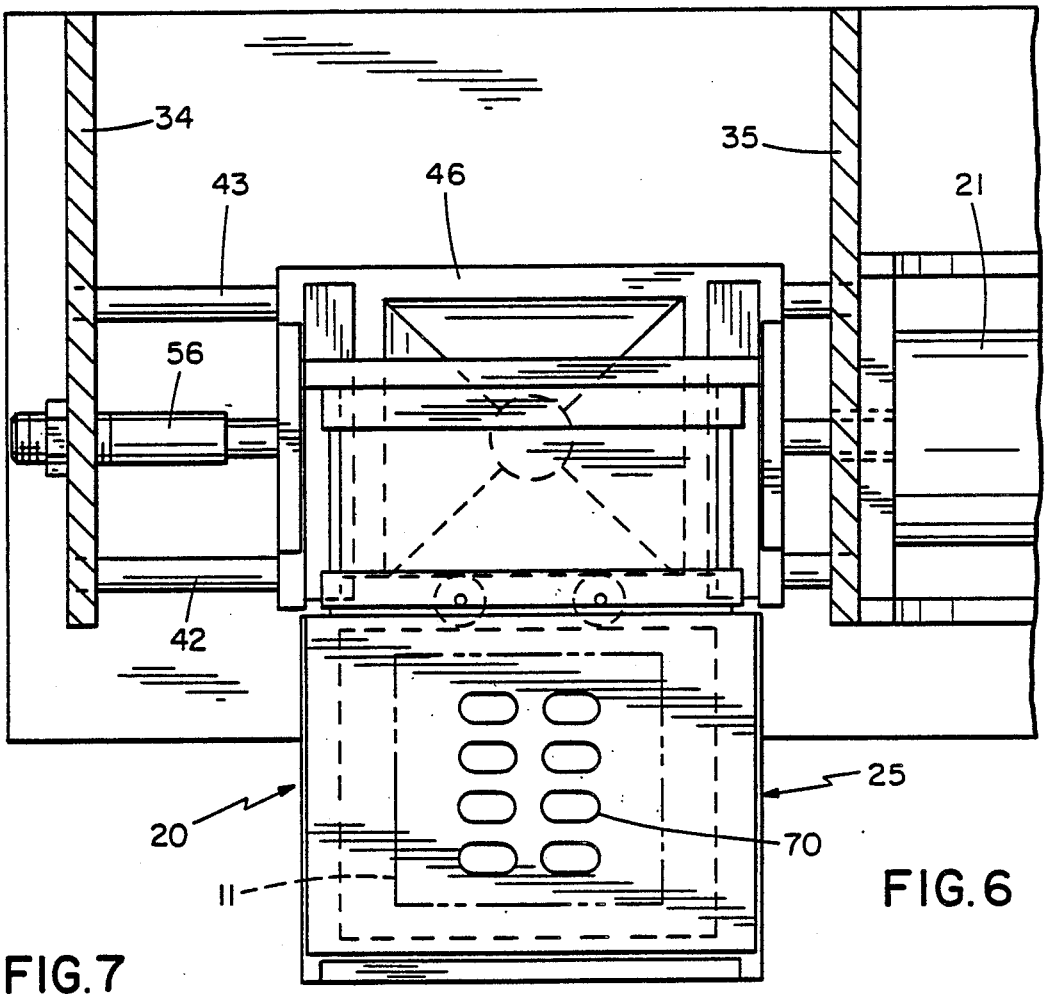
FIG. 6
FIG. 7
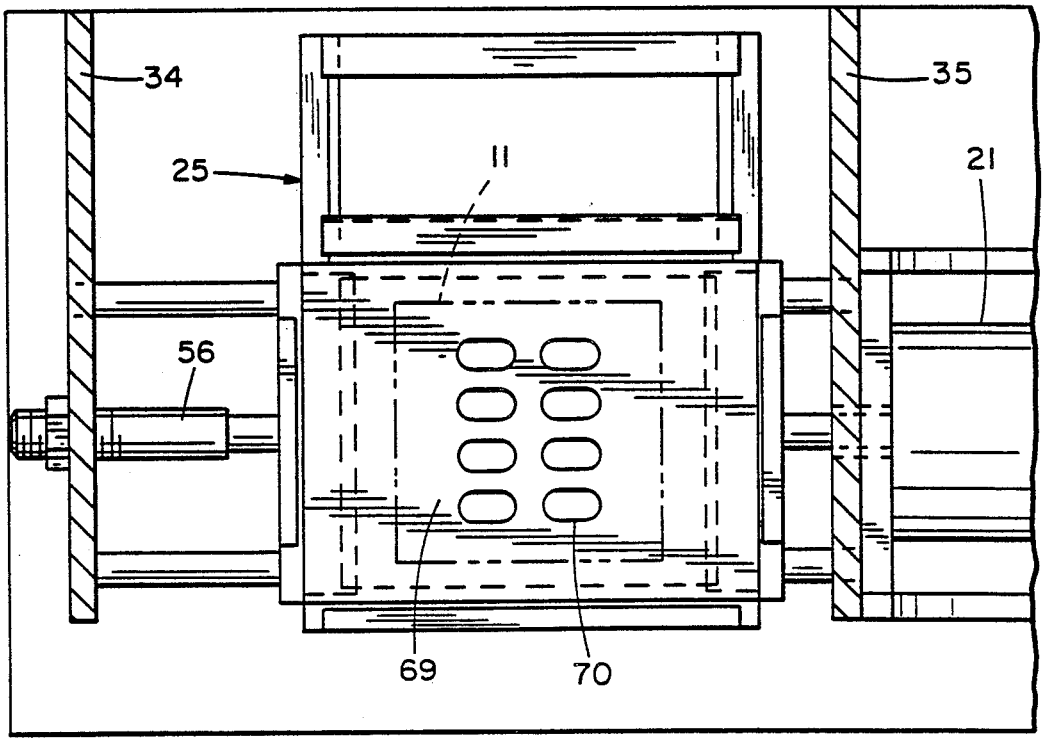

BLISTER PACKAGE OPENING METHOD AND APPARATUS

BACKGROUND OF THE INVENTION

Blister packaging has become increasingly popular over the last decade because of its low cost, its ability to hermetically seal the contained product against foreign matter, and its transparency which permits the product to be displayed to the purchaser.

These blister packages usually consist of a rigid or flexible back board laminated to a clear blister sheet after the product has been placed in its blisters. There may be one or more projections or blisters, and they are formed with a simple mold from a flat sheet.

Blister packaging has been extremely popular in the pharmaceutical industry because it permits a plurality of tablets or pills to be contained in a single blister package having a plurality of blisters on a single backboard. Some of these blister packages are called "push-through" packs that permit the product to be removed from the package by pressing on the blister forcing the pill or product out through a fragile backboard, and others have additional peel off backing adhered to a fragile foil, and in these the peel off back must be removed before the user can remove the product, and these are sometimes referred to as "child resistant" blister packs. In still other types of blister packages it is still necessary to puncture the blister itself in order to remove the product, although these have not found considerable success in pharmaceutical packaging because of the industry's recognition of providing an easy opening container for its market. The reclamation of pills in defective packages in the pharmaceutical industry is important not only to repackage and resell the product, but also to minimize hazardous waste if the damaged or defective packaging was discarded.

FDA requirements dictate that blister package machinery in the pharmaceutical industry be placed and operated in individual contamination-free rooms. Not so infrequently, these blister packaging machines either load the pills in the blister improperly or damage the blister packaging in some way rendering it unsaleable. Also by regulation, these defective packages must be reopened in the same contamination-free room housing the negligent blister packaging machine, and prior to the advent of de-blistering machines, this was done by a team of sterilized workers that moved from one packaging room to another in an effort to keep up with this monumental task of manually removing product from blister packages.

While there have been several de-blistering machines designed that have obtained some degree of commercial success, they are very costly and since one machine is required for each packaging room in a pharmaceutical house, and because they are not capable of opening all types of blister packages, many in the industry have chosen to stay with their manual human de-blistering teams.

One commercially available maching, manufactured by Sepha Products of Belfast, Ireland, has been devised for the push-through packages and for the peelable and child-resistant packages, but which require the peelable backing to be pulled away prior to insertion into the machine. The heart of this machine is a pair of mating rotating rollers with one of the rollers having one or more annular recesses therein for receiving the blisters and squeezing the blisters as the package goes between the rollers forcing the product through the back board.

Except for certain feeding problems, the Sepha machine is suitable for the press-out or push-through blister-type packages, but it is incapable of opening other types of blister packages.

Another somewhat more complicated machine has been devised for cutting C-shaped slots in the peelable back packaging, but this machine is quite complicated because it requires the step of cutting slots through the back board and then pressing the blister from the other side forcing the product through the slot into a collection tray. This machine is not only complex but expensive because special mandrels for pressing the blisters and special mandrels for cutting the C-shaped slots must be provided for each packaging configuration making this machine an extremely costly one.

Other objects and advantages of the present invention will appear more clearly from the following detailed description.

SUMMARY OF THE PRESENT INVENTION

In accordance with the present invention, a de-blistering machine and method are provided for blister packages of all types. This de-blistering method and apparatus are designed to open defective blister packages to recover their contained product by shifting an inverted blister package against a stationary knife edge with a carrier plate to partly but not completely sever the blisters and then by shifting the carrier plate in an opposite direction camming the partly severed blisters open to discharge the product.

Because this method and apparatus cut and open the blisters with the package upside down, permitting the tablets, pills or capsules to fall from the blisters, there is no necessity to either push the product through the backboard or to cut the backboard in any way greatly simplifying the method and apparatus compared to existing de-blistering machinery. This simplification results in a significant diminution in the manufacturing cost of the present machine thereby greatly expanding its market rendering it feasible for permanent installation in each packaging room described above.

The apparatus or machine according to the invention includes a stationary knife plate having a plurality of apertures therein with one lower side of each aperture being ground to form a knife edge coplanar with the top of the blade. The blister package is placed upside down against the top of this fixed knife plate and is held there by a pressure plate having a directionally serrated surface that permits the blister backboard to slide with respect to the pressure plate as it is moved by the carrier plate. The carrier plate has a similar series of apertures aligned with the apertures in the knife plate in their starting position.

After loading and clamping, as air cylinder actuator shifts the carrier plate sideways so that one side of the carrier apertures engages the blister portions protruding through the knife plate and shifts the entire blister package sideways against the knife plate cutting edges slicing the blisters immediately adjacent the backboards but it stops short of completely severing the blisters.

The actuator then shifts the carrier plate back to its starting position and when it does so, the other side of the carrier plate apertures, which is wedge-shaped, cams the partly severed blisters open (pivots them downwardly), permitting the product to drop from the blisters into a collection area. Thus, the same carrier plate has the dual functions of shifting the blister package to effect cutting and then stripping the product from the blister by camming the partly severed blisters open on its return stroke. This dual function of the carrier plate in part contributes to the remarkably low manufacturing cost of this system, but more importantly, contributes greatly to the reliability of the present de-blistering machine and its noteworthy characteristic of recovering product in an undamaged condition.

The carrier plate and the knife plate are locked together in one direction by interengaging guideways and both are inserted into a shift assembly transverse slideway in drawer-like fashion. With the drawer open, the blister cards are loaded on and unloaded from the knife plate, and after loading when the operator pushes the drawer closed, the machine cycle automatically begins.

Other objects and advantages of the present invention will appear more clearly from the following detailed description.

BRIEF DESCRIPTION OF THE DRAWINGS

FIG. 1 is a perspective view of the present blister package opening machine with its "drawer" open;

FIG. 2 is a perspective view of an exemplary blister package;

FIG. 3 is an enlarged perspective view of the present blister package opening machine with its "drawer" closed;

FIG. 6 is a fragmentary section showing the "drawer" in its open position taken generally along line 6—6 of FIG. 4;

FIG. 7 is a fragmentary section similar to FIG. 6 with the "drawer" closed;

DETAILED DESCRIPTION OF THE PREFERRED EMBODIMENT

Figure 4:
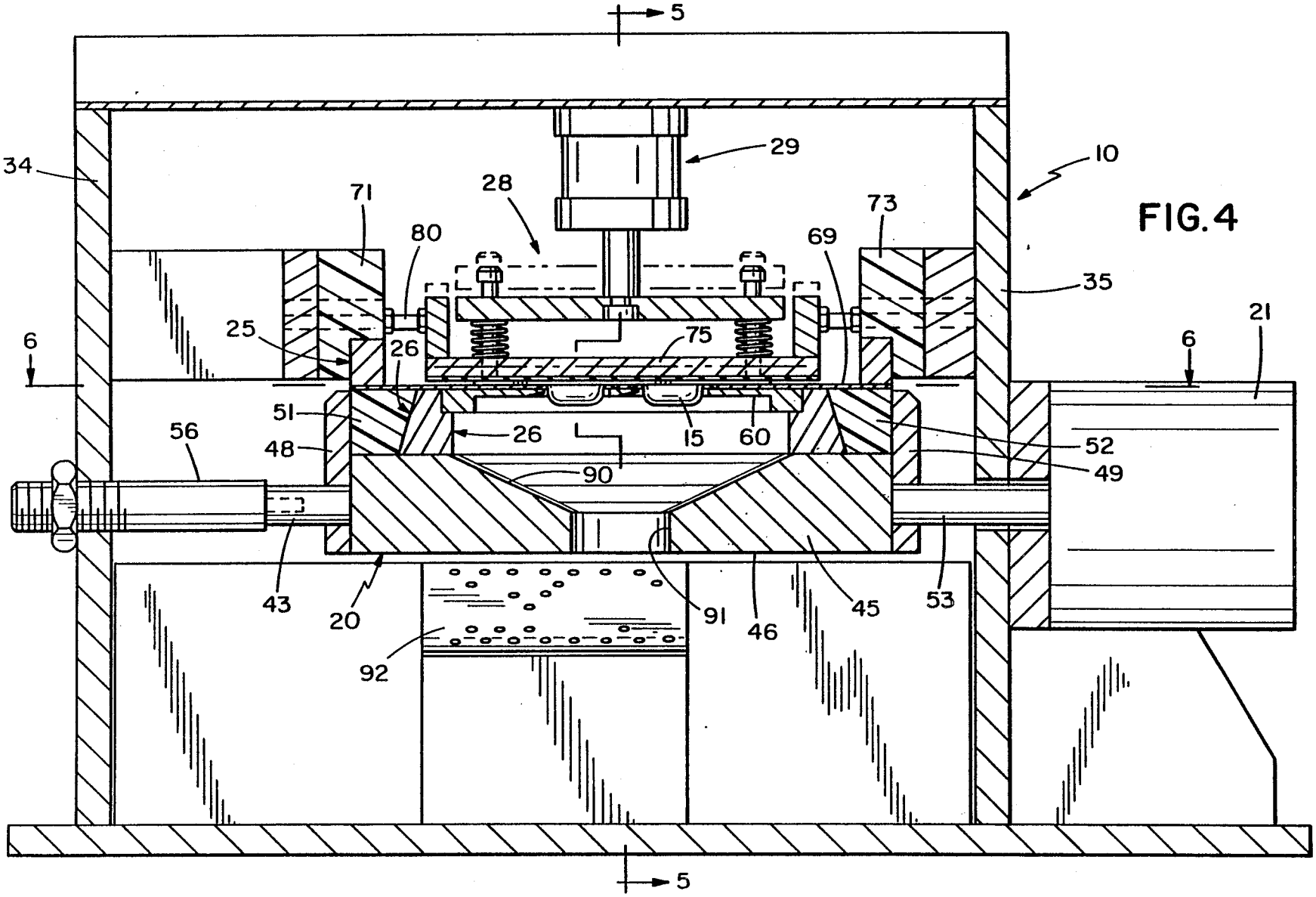
FIG. 4 is an enlarged longitudinal section of the blister package opening machine illustrated in FIGS. 1 and 3.
Figure 5:
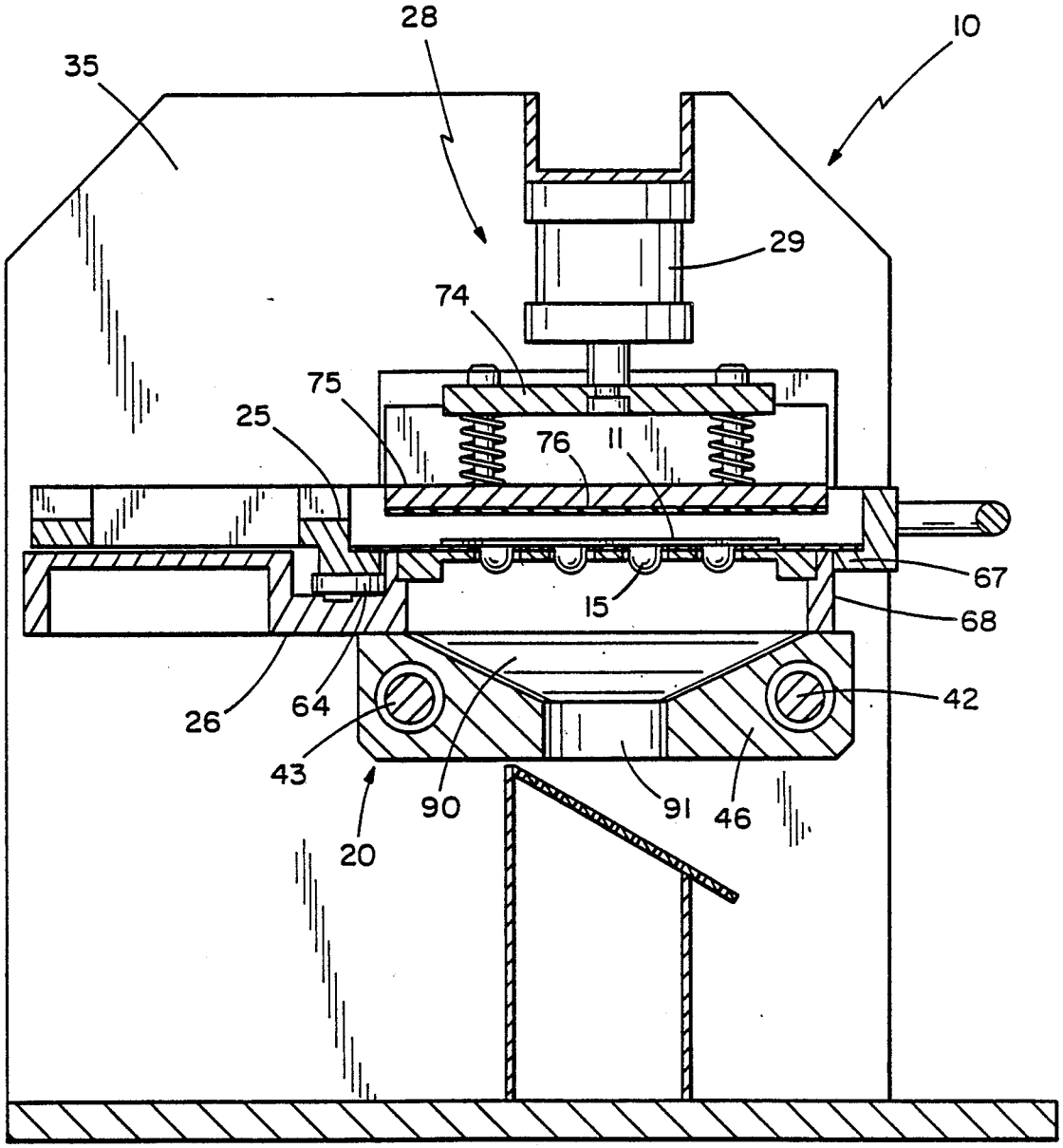
FIG. 5 is a cross-section of the present blister package opening machine taken generally along line 5—5 of FIG. 4.
Figure 8:
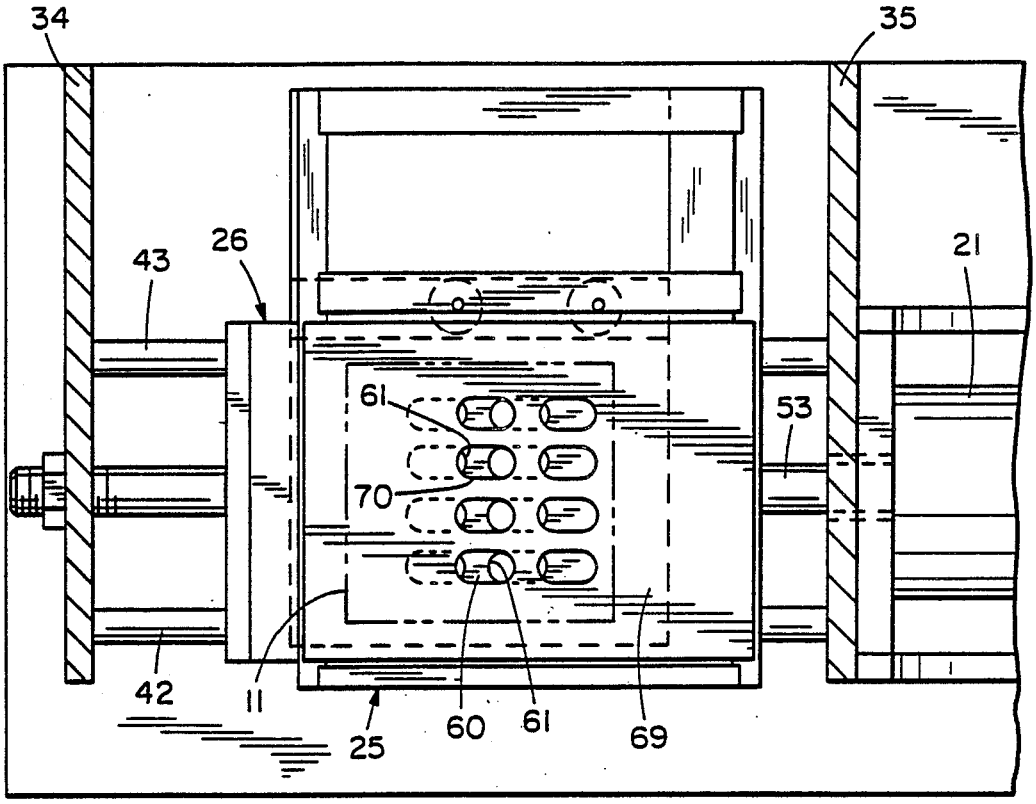
FIG. 8 is a fragmentary section similar to FIG. 7 with its carrier plate in an actuated position.
Figure 10:
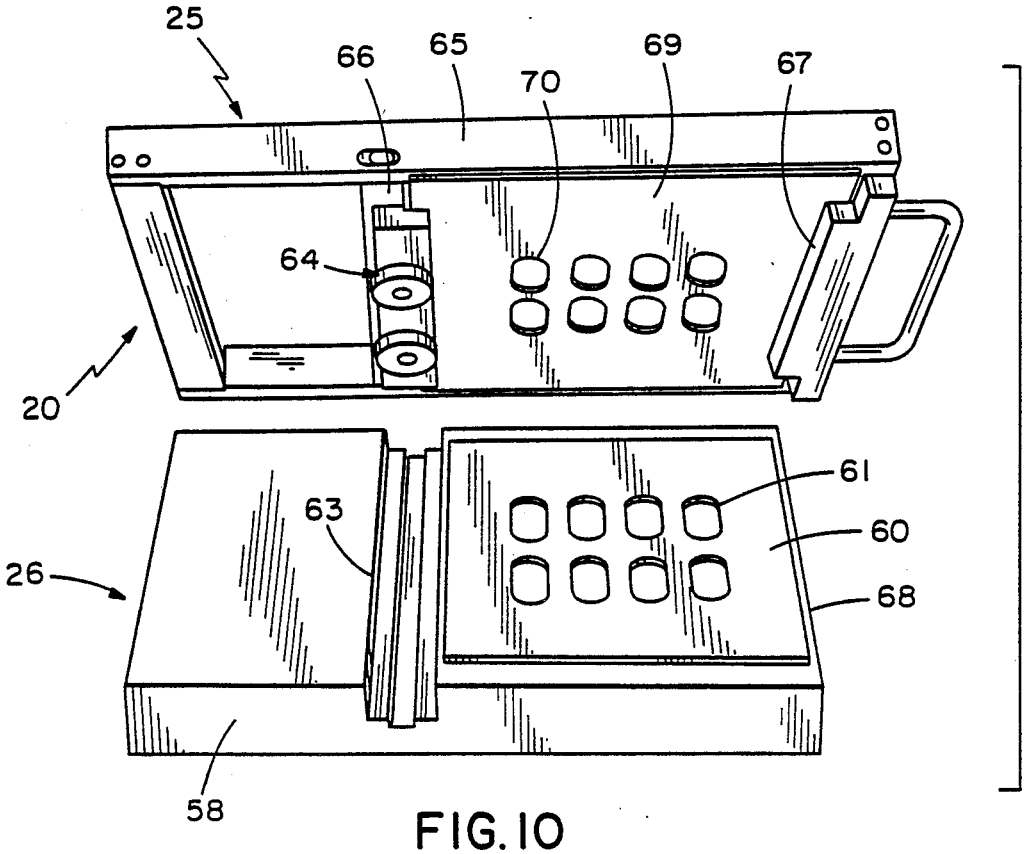
FIG. 10 is an exploded perspective view illustrating the carrier plate sub-assembly and the knife plate sub-assembly.

Referring to the drawings and particularly FIGS. 1 to 5 initially, the present blister package opening machine, or de-blistering machine, is generally designated by the reference numeral 10, and designed to open a blister package such as exemplary blister package 11 illustrated in FIG. 2, but it should be understood that the present machine with modified knife plates and carrier plates can accommodate a wide variety of blister packaging configurations. The exemplary blister package 11 includes a rigid or flexible backboard 13 laminated to a transparent blister sheet 14 having a plurality of upwardly projecting product containing blisters 15 thereon. While the blister package is shown in an upwardly facing position in FIG. 2, it should be understood that de-blistering machine 10 effects blister opening with the blister package 11 in an inverted position such as illustrated in FIGS. 1, 4 and 5.

The general configuration of machine 10 includes a frame assembly 18, a shift assembly 20 operated by a pneumatic cylinder 21, a drawer assembly 24 including a knife plate assembly 25 and a carrier plate assembly 26 insertable together into the shift plate assembly 20, and a clamping plate assembly 28 operated vertically by a second pneumatic cylinder 29 for clamping the blister package 11 down against knife plate assembly 25.

As seen clearly in FIGS. 11 to 14, the present de-blistering machine operates by partly severing all of the blisters 15 simultaneously immediately adjacent the backboard 13 and then opening the partly severed blisters to permit the product to fall downwardly into a collection area, and this methodology will appear more clearly from the following description.

The frame assembly 18 includes a horizontal rectangular base 32 to which are welded spaced parallel vertical frame plates 34 and 35 having an upward channel-shaped cross member 36 on which cylinder 29 is mounted. Frame member 35 is additionally supported by spaced side plates 38 and 39 along side a head plate 40 supporting pneumatic cylinder 21.

The shift assembly 20 includes a pair of spaced parallel guide rods 42 and 43 supported in and extending between the side frame members 34 and 35. A carriage assembly 45, which forms a part of the shift assembly 20, has a lower plate 46 slidably mounted on rods 42 and 43 with side plates 48 and 49 (see FIGS. 4 and 5) that lock nylon dovetail guides 51 and 52 to the top of plate 46. Actuator piston rod 53 extends through plate 49 and is connected to plate 46 for the purpose of reciprocating the entire carriage assembly 45 on rods 42 and 43. An adjustable stop 56 is provided to limit transverse motion of the carriage assembly 45 to the left from its neutral position illustrated in FIG. 4, to thereby variably control the extent of severing the blisters 15.

The drawer assembly 24 is slidable in the shift assembly guideways 51 and 52 although only the carrier plate assembly 26 directly engages the guides 51 and 52 thereby permitting the shift assembly 20 to shift the carrier plate assembly plate 26 laterally while the knife plate assembly 25 remains laterally stationary during the de-blistering process.

As seen in FIGS. 5, 6, 7, 8 and 10, the carrier plate assembly 26 has converging side walls 58 that slidably engage the dove-tail guideways 51 and 52 in the shift assembly as seen in FIG. 4, and it has a removable carrier plate 60 therein having a plurality of elongated apertures 61 corresponding in number but slightly larger than the blisters 15 on the package 11 being de-blistered. Carrier plate assembly 26 also includes a transverse guideway 63 that receives a roller assembly 64 on the bottom of the knife plate assembly 25 that permits the carrier plate assembly 26 to shift transversely with respect to the knife assembly 25. The knife assembly 25 consists of a rectangular frame 65 with a cross member 66 that supports roller assembly 64 and a second cross member 67 that engages forward wall 68 in the carrier assembly as seen more clearly in FIG. 5 to guide the carrier plate assembly 26 with respect to the knife plate assembly 25 with the roller assembly 64.

The knife plate assembly 25 also includes a knife plate 69 with a plurality of elongated apertures 70 therein approximately the same size and shape as the apertures 61 in the carrier plate 60. One end of each of the apertures 70 is ground as seen in FIGS. 11 to 14 to form a knife edge 72. Knife plate frame 65 is insertable into fixed guideways 71 and 73 (see FIG. 4) carried by frame plates 34 and 35, and these guides prevent transverse movement of the knife plate assembly.

Note that both the knife plate assembly 25 and the carrier plate assembly 26 are sufficiently long so that the carrier plate assembly remains securely held by the shift assembly guideways and the knife plate assembly is held by the guideways 71 and 73 when the drawer assembly is in its open loading position illustrated in FIGS. 1 and 6.

The clamping assembly 28 is provided for holding the package 11 in an inverted position against the top of the knife plate assembly 25 and at the same time it permits the package 11 to slide laterally upon the initial cutting stroke of the carrier plate assembly 26. Toward these ends, the carrier plate assembly as seen in FIG. 6 includes a horizontal frame plate 74, that supports a spring mounted pressure plate 75 having a lower surface 76 that has sawtooth serrations parallel to guideways 71 and 73 facing to the left that permit the blister package to slide to the left with respect to the plate but prevent it from sliding back to the right.

The card is loaded in an inverted position on top of the knife plate assembly 25 with the drawer assembly in its open position illustrated in FIGS. 1 and 5. The drawer assembly is then closed, tripping a switch that initiates the machine cycle. Note in FIGS. 3 and 4 that stops 80 engage the side of the pressure plate 75 to prevent lateral movement of the pressure plate during the operating cycle.

After switch initiation, actuator 29 lowers the pressure plate 75 into engagement with the package backboard pressing it firmly against the upper surface of knife plate 69. Immediately thereafter, pneumatic actuator 21 drives the shift assembly 20 laterally moving the carrier plate assembly 26 laterally with respect to the knife plate assembly 25.

As seen in FIGS. 11 to 14, each of the carrier plate apertures 61 has a vertical wall 84 at one end thereof and a tapered wall 85 at the other end thereof.

Figure 11:
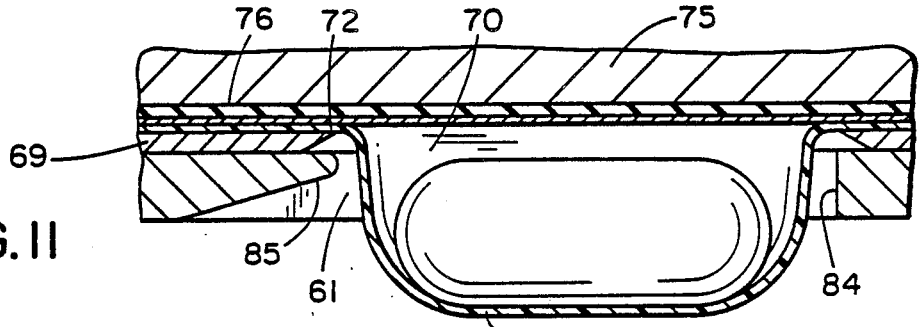
FIGS. 11 to 14 are enlarged fragmentary sections of the cooperating knife plate and carrier plate assemblies respectively in their load, partly actuated, fully actuated, and returned positions.
Figure 12:
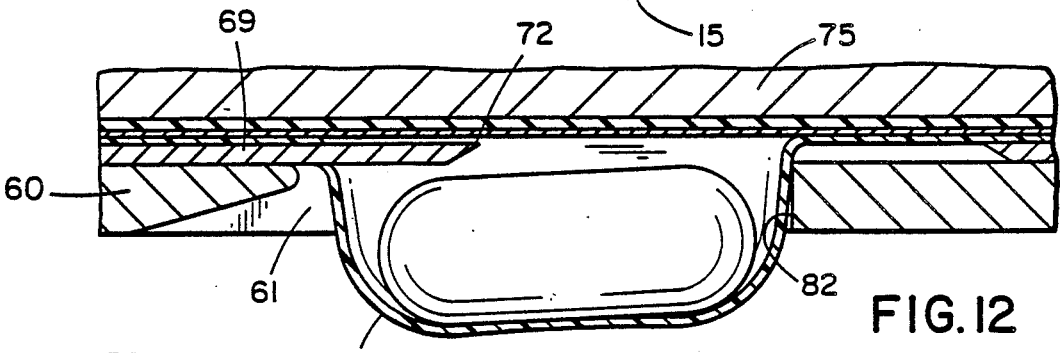
Figure 13:
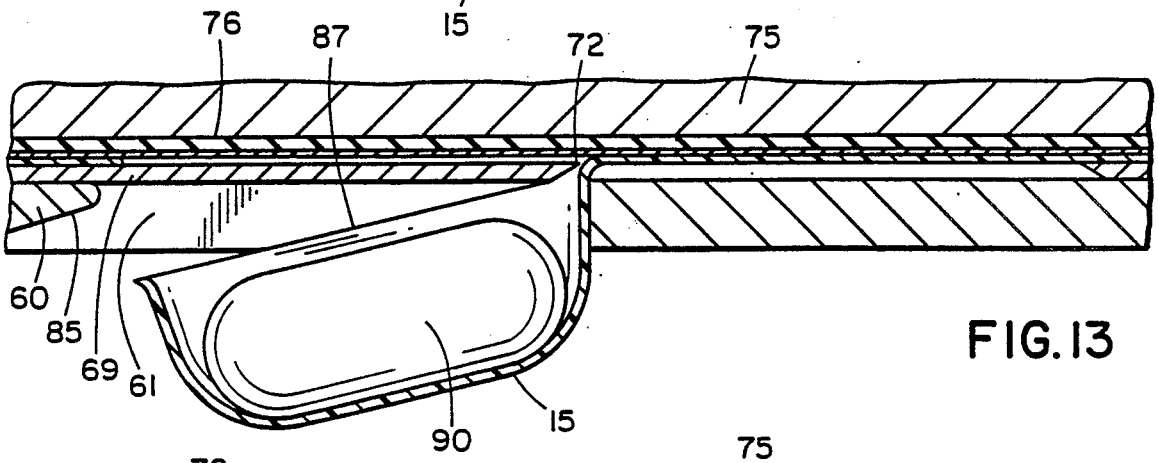

When the plate 60 shifts to the left from its position shown in FIG. 11 to its intermediate FIG. 12 position, carrier plate aperture walls 82 engage the sides of blisters 15 so that as the carrier plate moves from its position shown in FIG. 12 to its full limit of stroke position shown in FIG. 13, walls 82 cause the entire blister package 11 to be shifted to the left, permitted by the directional serrations on pressure plate surface 76.

Adjustable stop 56 limits the end of stroke of the carrier plate assembly 26 to the FIG. 13 limit position.

Figure 9:
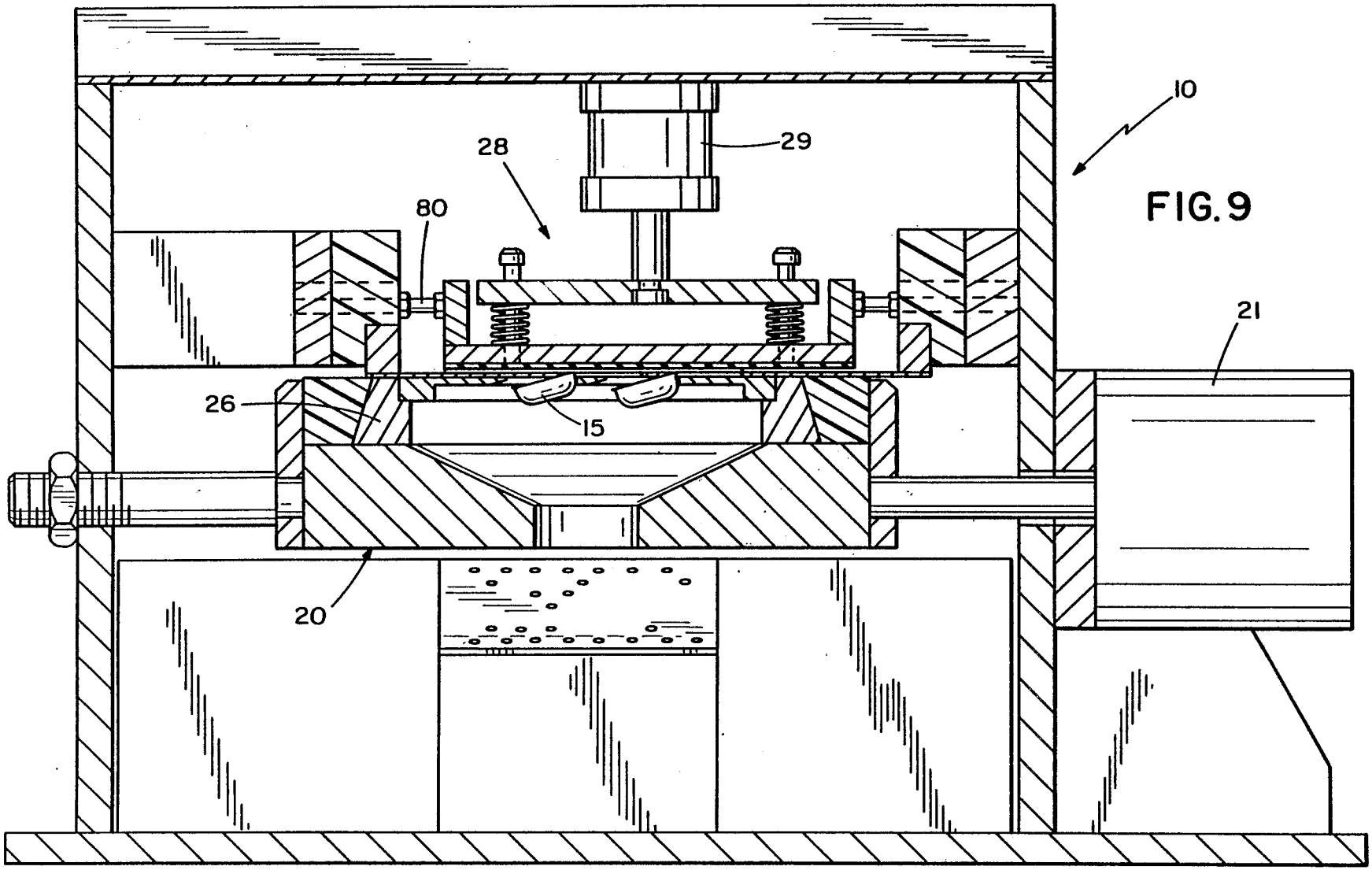
FIG. 9 is a longitudinal section similar to FIG. 4 with the shift assembly and carrier plate in their actuated positions.

Stop 56 is adjusted so that the end of stroke position illustrated in FIG. 13 severs all but approximately 0.030 to 0.050 inches of the blisters 15. Note the fully shifted position of the carrier plate and the package illustrated in FIGS. 8 and 9.

Figure 14:
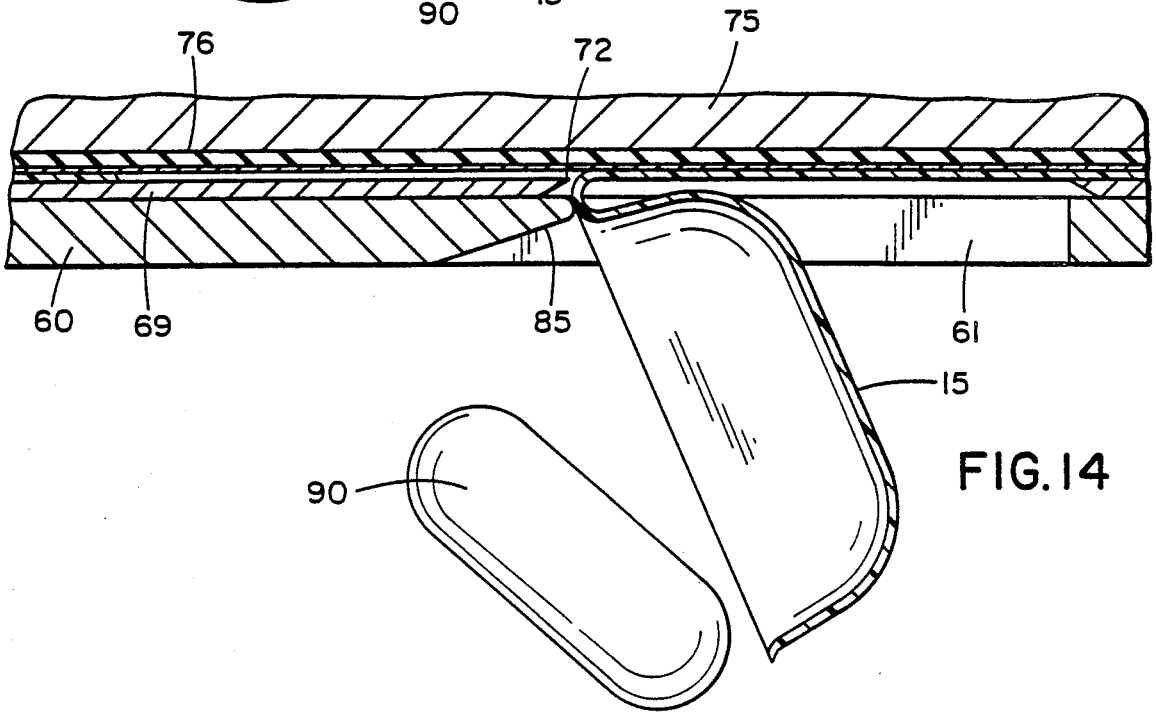

The actuator 21 then automatically reverses with suitable controls, pulling the shift assembly 20 and the carrier plate 60 back to their original starting positions illustrated in FIG. 14. Note that after the partial severing of the blisters 15 illustrated in FIG. 13, the weight of product 90 pivots the blister downwardly about the still attached portion of the blister.

As the carrier plate shifts back toward its starting position illustrated in FIG. 14, the other tapered end of the apertures 61, namely tapered walls 85, engage the blisters 15 along their cut line 87 pivoting the blisters to their position illustrated in FIG. 14, rotated more than 90 degrees from their original position permitting product 90 to fall from the blister. The package is prevented from moving during this return stroke by the serrations on lower surface 76 that grip the back of the package.

The dropping product is directed by frusto-conical surface 90 in shift plate 46 through a central aperture 91 to a deflector assembly 92 that directs the product to a suitable container (not shown).

I claim:

1. An apparatus for removing a product from a blister package consisting of a backing board with a blister sheet attached having a flat portion with at least one protruding product containing blister integrally formed with and extending outwardly from the flat portion, comprising: a knife plate parallel to and adjacent the sheet flat portion, means for moving the blister packagge relative to the knife plate to cut the blister partly from the sheet flat portion with the blister projecting downwardly, and means for opening the blister sufficiently to permit the product to fall downwardly.

2. An apparatus for removing a product from a blister package as defined in claim 1, wherein the almost completely cutting the blister from the flat portion.

3. An apparatus for removing a product from a blister package as defined in claim 2, wherein the means for cutting the blister includes means to cut the blister sufficiently so that a severed portion may pivot with respect to the backing board, and said means for opening the blister including means for pivoting the severed portion downwardly to release the product permitting it to fall downwardly.

4. An apparatus for removing a product from a blister package as defined in claim 1, wherein the means for cutting includes a stationary knife plate with a knife edge aperture therein, and means for moving the blister into engagement with the knife edge.

5. An apparatus for removing a product from a blister package as defined in claim 4, wherein said knife plate is constructed to receive the blister package on the top thereof with the blister projecting into the knife plate aperture, and said means for opening the blister including a carrier plate beneath the knife plate moveably mounted to engage the blister and shift the blister into engagement with the knife edge.

6. An apparatus for removing a product from a blister package as defined in claim 5, including a cover plate over the knife plate engageable with the blister package to hold it into engagement with the top of the knife plate.

7. An apparatus for removing a product from a blister package as defined in claim 6, wherein said carrier plate has an aperture therein adapted to engage the blister to move it into engagement with the knife edge when moving in a first direction and engaging the blister to pivot it open permitting discharge of the product when moving in a second direction.

8. An apparatus for removing a product from a blister package consisting of a backing board with a blister sheet attached having a flat portion with at least one protruding product containing blister integrally formed with and extending outwardly from the flat portion, comprising: a stationary knife plate parallel and adjacent the sheet flat portion with an aperture therein defining a knife edge, the upper surface of the knife plate being constructed to receive the blister package with the blister projecting downwardly through the knife plate aperture, and a carrier plate mounted beneath the knife plate and moveable into engagement with the blister to shift the entire blister package sufficiently to incompletely sever the blister from the sheet flat portion, and means for receiving the product from the partly severed blister.

9. An apparatus for removing a product from a blister package consisting of a backing board with a blister sheet attached having a flat portion with at least one protruding product containing blister integrally formed with and extending outwardly from the flat portion, comprising: a stationary knife plate with an aperture therein defining a knife edge, the upper surface of the knife plate receiving the sheet portion and being constructed to receive the blister package with the blister projecting downwardly through the knife plate aperture, and a carrier plate mounted adjacent, parallel to and beneath the knife plate and moveable into engagement with the blister to shift the entire blister package sufficiently to incompletely sever the blister from the sheet flat portion, said carrier plate being moveable in a first direction to shift the blister into engagement with the knife edge and moveable in a second direction to engage and open the severed blister to permit discharge of the product therefrom.

10. An apparatus for removing a product from a blister package as defined in claim 9, including a clamping plate for holding the blister package in engagement with the knife plate, said clamping plate having a low friction pad engageable with the blister package that permits the package to slide as the carrier plate shifts the package.

11. An apparatus for removing a product from a blister package as defined in claim 9, including a shift assembly for moving the carrier plate, a piston and cylinder device for moving the shift assembly, said shift assembly having a slideway for receiving the carrier plate, said carrier plate and knife plate having interengaging guideways transverse to the shift assembly slideway, and a clamp assembly mounted for vertical movement over the knife plate to clamp the package against the top of the knife plate.

12. An apparatus for removing a product from a blister package consisting of a backing board with a blister sheet attached having a sheet portion with at least one protruding product containing blister integrally formed with and extending outwardly from the flat portion, comprising: a stationary knife plate with an aperture therein defining a knife edge, the upper surface of the knife plate receiving the sheet flat portion and being constructed to receive the blister package with the blister projecting downwardly through the knife plate aperture, a carrier plate mounted adjacent, parallel to and beneath the knife plate and moveable into engagement with the blister to shift the entire blister package sufficiently to incompletely sever the blister from the sheet flat portion, said carrier plate being moveable in a first direction to shift the blister into engagement with the knife edge and moveable in a second direction to engage and open the severed blister to permit discharge of the product therefrom, a clamping plate for urging the blister package into engagement with the knife plate, said clamping plate having a low friction pad engageable with the blister package that permits the package to slide as the carrier plate shifts the package, a shift assembly for moving the carrier plate, and a piston and cylinder device for moving the shift assembly, said shift assembly having a slideway for receiving the carrier plate, said carrier plate and knife plate having interengaging guideways transverse to the shift assembly slideway.

13. A method for removing a product from a blister package consisting of a backing board with a blister sheet attached having a flat portion with at least one protruding product containing blister integrally formed with and extending outwardly from the flat portion, including the steps of: cutting the blister partly from the sheet flat portion with a knife plate parallel and adjacent the sheet flat portion with the blister projecting downwardly, and opening the blister sufficiently by moving the blister package selector to the knife plate to permit the product to fall downwardly.

14. A method for removing a product from a blister package as defined in claim 13, wherein the step of cutting the blister includes incompletely cutting the blister between the backing board and the contained product.

15. A method for removing a product from a blister package as defined in claim 14, wherein the step of cutting the blister includes cutting the blister sufficiently so that a severed portion may pivot with respect to the backing board, and the step of opening the blister includes pivoting the severed portion to release the product to permit it to fall downwardly.

16. A method for removing a product from a blister package as defined in claim 13, wherein the step of cutting includes moving the blister into engagement with a stationary knife plate having a knife edge aperture therein.

17. A method for removing a product from a blister package as defined in claim 16, wherein the step of cutting includes placing the package on the top of the knife plate with the blister projecting into the knife plate aperture, and moving a carrier plate beneath the knife plate to engage the blister and shift the blister into engagement with the knife edge.

18. A method for removing a product from a blister package as defined in claim 17, including engaging a cover plate over the knife plate with the blister package to hold it in engagement with the top of the knife plate.

19. A method for removing a product from a blister package as defined in claim 18, including moving said carrier plate with an aperture therein adapted to engage the blister to move it into engagement with the knife edge when moving in a first direction and engaging the blister to pivot it open permitting discharge of the product when moving in a second direction.

20. A method for removing a product from a blister package consisting of a backing board with a blister sheet attached having a flat portion with at least one protruding product containing blister integrally formed with and extending outwardly from the flat portion, including the steps of: placing the package on top of a stationary knife plate parallel to the sheet flat portion with an aperture therein defining a knife edge with the blister projecting downwardly, moving a carrier plate beneath the knife plate into engagement with the blister to shift the entire blister package sufficiently to incompletely sever the blister from the sheet flat portion, and moving the carrier plate in a second direction to engage and open the severed blister sufficiently to permit discharge of the product therefrom.

21. A method of removing a product from a blister package as defined in claim 20, including moving a clamping plate for engaging the blister package with the knife plate, said clamping plate having a low friction pad engageable with the blister package that permits the package to slide as the carrier plate shifts the package.

* * * * *